United States Patent [19]

Ruger et al.

[11] 3,971,150

[45] July 27, 1976

[54] TOP LEVER RETAINING MEANS FOR BREAK-OPEN FIREARMS

[75] Inventors: William B. Ruger, Southport; Lawrence L. Larson, Bethany, both of Conn.

[73] Assignee: Sturm, Ruger & Co. Inc., Southport, Conn.

[22] Filed: Apr. 22, 1975

[21] Appl. No.: 570,445

[52] U.S. Cl. ..... 42/44
[51] Int. Cl.[2] ..... F41C 11/08
[58] Field of Search ..... 42/44, 45, 40

[56] References Cited

UNITED STATES PATENTS

| | | | |
|---|---|---|---|
| 264,727 | 9/1882 | Mason | 42/44 |
| 514,574 | 2/1894 | Tonks | 42/44 |
| 847,564 | 3/1907 | Fittipaldi et al. | 42/44 |
| 1,137,045 | 4/1915 | Barnes | 42/44 |
| 1,787,004 | 12/1930 | Jefferson | 42/44 |

*Primary Examiner*—Charles T. Jordan
*Attorney, Agent, or Firm*—Pennie & Edmonds

[57] ABSTRACT

A break-open type firearm having a frame, one or more barrels pivotally mounted on the frame, a barrel lock bolt for releasably locking the barrel at its closed position and a top lever for moving the barrel lock bolt from its barrel locking position to its barrel unlocking position is provided with novel means for retaining the top lever in the lever receiving opening of the frame. The top lever has a vertically elongated lock bolt operating crank that is rotatably received in the lever receiving opening of the frame, the operating crank having a spring strut receiving notch formed therein. The frame has a lever retaining shelf located in the lever receiving opening of the frame and a spring strut retaining shelf located below the lever receiving opening adjacent the upper end of the strut receiving notch of the operating crank. The lever retaining shelf has an operating crank passageway that permits the passage therethrough of the operating crank when the top lever is at its barrel locking position, the lever retaining shelf blocking upward movement of the operating crank and the top lever when the top lever is at its barrel unlocking position. The forward end of the top lever spring strut is received in the strut receiving notch of the operating crank, the strut retaining shelf blocking upward movement of the spring strut and the top lever when the top lever is at its barrel locking position.

8 Claims, 8 Drawing Figures

TOP LEVER RETAINING MEANS FOR BREAK-OPEN FIREARMS

BACKGROUND OF THE INVENTION

1. Field of the Invention

This invention relates to break-open type firearms having a top lever that, when rotated from its barrel locking position to its barrel unlocking position, permits the barrel to be rotated from its closed firing position to its open loading position.

2. Prior Art

The break-open type of firearms to which the present invention relates includes, but is not limited to, single and double barrel rifles and shotguns. These firearms have one or more barrels pivotally mounted on the frame of the firearm, the barrel or barrels being rotatable from their closed ready-to-fire position to their open loading and unloading position in the manner known in the art. A barrel lock bolt is mounted on the frame for releasably locking the barrels at their closed position, the lock bolt being movable from its barrel locking position to its barrel unlocking position by means of a top lever that is rotatably mounted on the top of the frame. When the top lever is rotated to its barrel unlocking position, the barrel lock bolt is withdrawn from engagement with the barrels thereby permitting the barrels to be rotated from their closed position to their open position, and when the top lever is rotated to its barrel locking position the barrel lock bolt is moved into engagement with the barrels to lock the barrels at their closed position. A top lever spring urges the top lever and the barrel lock bolt to their barrel locking positions so that the barrels are normally maintained at their closed position.

The top lever is removably mounted on the frame to facilitate cleaning and repair of this and other parts of the mechanism of the firearm. The top lever is commonly retained on the frame by means of a screw or similar part that extends through the top lever to the frame along the vertical axis of rotation of the top lever, the retaining means being secured to the frame by a nut or a threaded hole or the like. Screw type top lever retaining means sometimes become loose due to vibration and shock when the firearm is being fired with consequent possible damage to the firearm or injury to the shooter. In addition, screw type retaining means can become lost or damaged when the firearm is disassembled for cleaning or repair.

We have now devised a significant improvement in the means for retaining the top lever in the frame of break-open type firearms that does away with the need for separate parts for the retainer means, such as the aforementioned screw type retainer. In our new retainer arrangement the top lever is removably retained in the frame solely by virtue of the unique configuration of the top lever and the frame and by the interaction of these parts with each other and with the top lever spring and spring strut of the firearm.

SUMMARY OF THE INVENTION

The present invention relates to break-open firearms that have a frame and at least one barrel pivotally mounted on the frame, the barrel being rotatable from its closed ready-to-fire position to its open loading and unloading position and return. A barrel lock bolt is movably mounted on the frame for releasably locking the barrel at its closed position and a top lever is removably mounted on the frame, the top lever being rotatable to move the lock bolt from its barrel locking position to its barrel unlocking position and return. A top lever spring urges the top lever and the bolt lock to their barrel locking position, and top lever retaining means retain the top lever on the frame.

The improvement in top lever retaining means of the invention comprises a top lever having a bearing surface adapted to rest on a corresponding support surface of the frame, and a vertically elongated lock bolt operating crank disposed a predetermined distance below the bearing surface of the top lever. The operating crank is radially offset with respect to the vertical axis of rotation of the top lever and is formed with a spring strut receiving notch and a lock bolt operating portion. The frame has a top lever receiving opening in which the top lever is rotatably received, a lever retaining shelf located at the top lever receiving opening of the frame, and a spring strut retaining shelf located below the top lever receiving opening of the frame adjacent the upper end of the spring strut receiving notch of the operating crank. The lever retaining shelf has an operating crank passageway that permits the passage therethrough of the operating crank of the top lever when the top lever is at its barrel locking position, upward movement of the operating crank and the top lever being blocked by the under surface of said lever retaining shelf when the top lever is at its barrel unlocking position. A top lever spring and spring strut are mounted in the frame rearwardly of the top lever with the forward end of the spring strut received in the spring strut receiving notch of the operating crank of the top lever, upward movement of the forward end of the spring strut and the top lever being blocked by the under surface of the strut retaining shelf when the top lever is at its barrel locking position.

The top lever is also advantageously formed with a lever retainer lug disposed a predetermined distance below the bearing surface of the top lever, said lever retainer lug extending radially horizontally with respect to the vertical axis of rotation of the top lever. The lever retaining shelf of the frame is then formed with a lever retainer lug passageway that permits the passage therethrough of the lever retainer lug when the top lever is at its barrel locking position. The lever retaining shelf blocks upward movement of the lever retainer lug and the top lever when the top lever is at its barrel unlocking position.

It will be seen that when the top lever is at its barrel locking position it is retained in the lever receiving opening of the frame by the strut retaining shelf which blocks upward movement of the spring strut and the top lever, and when the top lever is at its barrel unlocking position it is retained in the lever receiving opening by the lever retaining shelf which blocks upward movement of both the operating crank and the retainer lug of the top lever. The top lever is removed from the frame by moving the spring strut out of engagement with the strut receiving notch of the top lever as hereinafter described, by aligning the operating crank and the retainer lug of the top lever with the operating crank passageway and the retainer lug passageway of the lever retaining shelf of the frame, and by then lifting the top lever out of the lever receiving opening of the frame.

BRIEF DESCRIPTION OF THE DRAWINGS

Our improvement in top lever retaining means for break-open firearms will be better understood from the following description thereof in conjunction with the accompanying drawings of which.

DESCRIPTION OF PREFERRED EMBODIMENT

Figure 1:
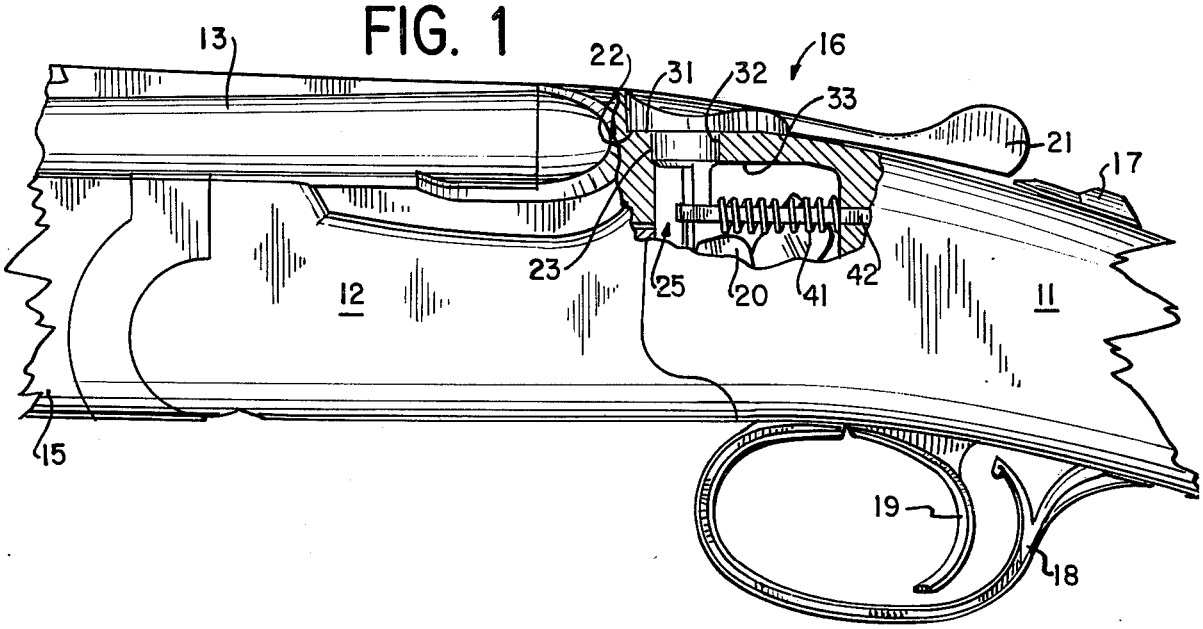
FIG. 1 is a fragmentary side elevation, partly broken away, of a break-open firearm embodying the top lever retaining means of the invention.

The retaining means for the top lever of break-open type firearms is described herein in conjunction with the over-and-under shotgun shown in FIG. 1 of the drawing, but it is not limited to this particular break-open firearm. As best shown in FIG. 1 the over-and-under shotgun embodying the improvement of the invention comprises, in its major components, a stock 11, a frame 12 mounted on the stock 11, the frame having a rearwardly extending portion 12*a* that is received in and partly concealed by a slot formed in the stock 11, an upper barrel 13 and a lower barrel (not visible) pivotally mounted on the frame 12, and a forearm stock 15. A barrel locking and unlocking top lever 16 is removably mounted on the frame 12, the top lever 16 being rotatable from its barrel locking position to its barrel unlocking position to permit the barrels to be rotated from their closed firing position shown in FIG. 1 to their open loading and unloading position (not shown). Also mounted on the frame 12 are the barrel selector and safety lever 17, the trigger guard 18, the trigger 19, the hammer 20 and the other parts of the firing mechanism (not shown).

Figure 2:
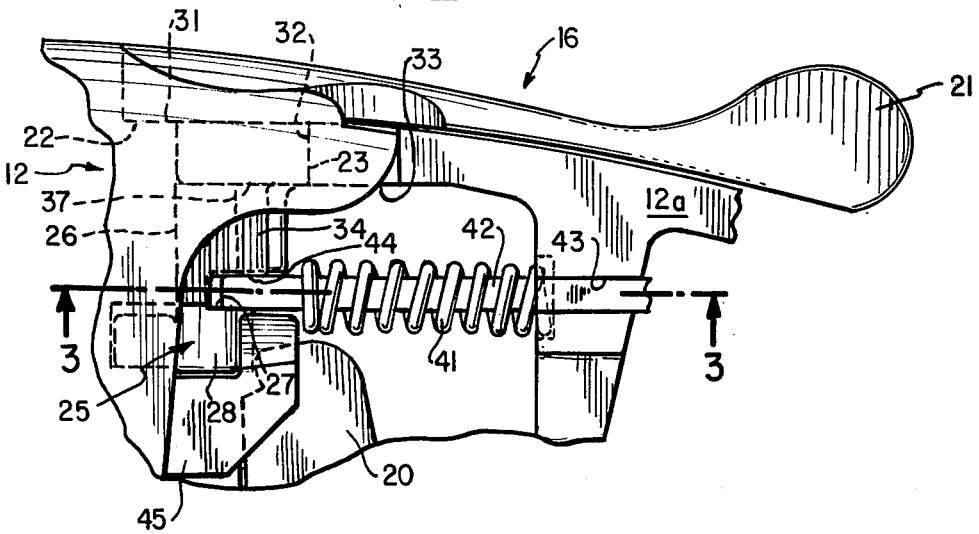
FIG. 2 is an enlarged side elevation of the top lever and the immediately adjacent portion of the frame (with the stock removed) showing the top lever and the spring strut at their barrel locking positions.
Figure 3:
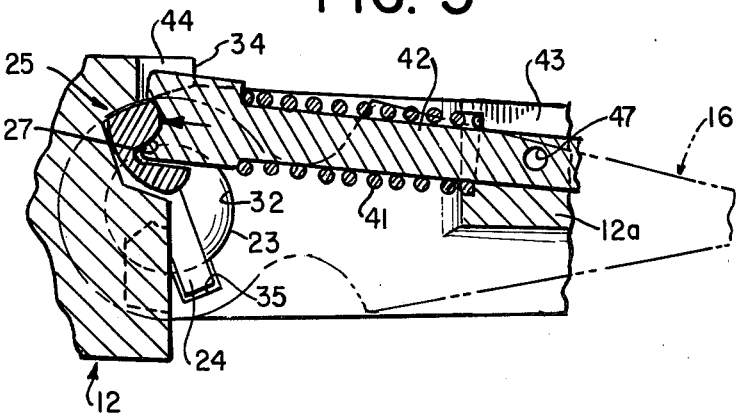
FIG. 3 is a sectional view from below along line 3—3 of FIG. 2 showing the top lever and spring strut at their barrel locking positions.
Figure 7:
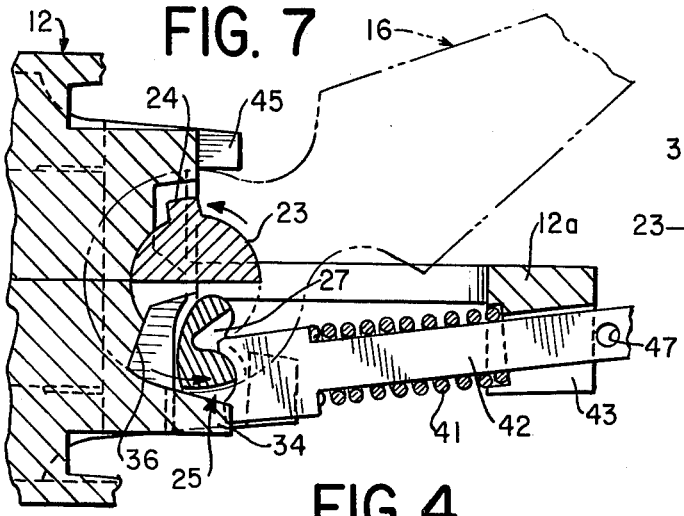
FIG. 7 is a sectional view from above along line 7—7 of FIG. 6 showing the top lever and spring strut in their barrel unlocking positions.
Figure 5:
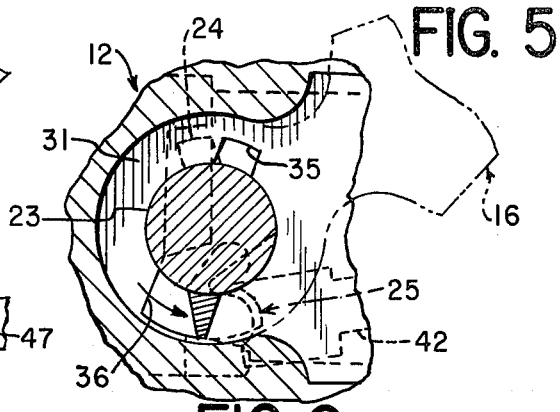
FIG. 5 is a sectional view along line 5—5 of FIG. 4.
Figure 8:
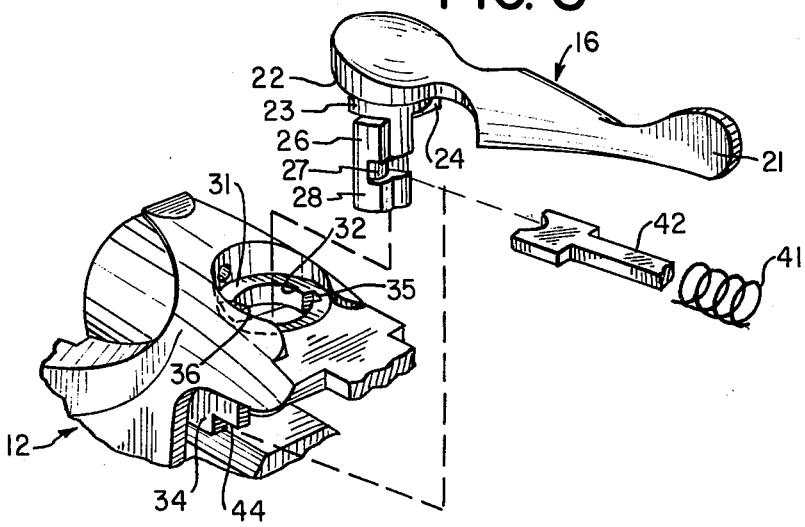
FIG. 8 is an exploded perspective view of the top lever and the immediately adjacent portions of the frame and spring strut.

As shown best in FIGS. 1, 3 and 8, the top lever 16 has a lever arm 21, a generally horizontally disposed downwardly facing annular bearing surface 22, an axial hub 23 that coincides with the vertical axis of rotation of the top lever, a retainer lug 24 that extends radially with respect to the vertical axis of rotation of the top lever and a vertically elongated lock bolt operating crank 25 that is radially offset with respect to said axis of rotation of the top lever. The operating crank 25 has a lever retainer upper portion 26, a spring strut receiving notch 27 and a lock bolt operating lower portion 28. The annular bearing surface 22 of the top lever rests on a corresponding upwardly facing annular support surface 31 of the frame, and the hub 23 is rotatably received in a lever receiving opening 32 formed in the frame 12. Thus, the top lever 16 is rotatably mounted on the frame and is rotatable from its barrel locking position as shown in FIGS. 1 to 3 to its barrel unlocking position as shown in FIGS. 4 to 7, and return.

The frame 12 is formed with the aforementioned upwardly facing annular support surface 31 and the top lever receiving opening 32. The frame is also formed with a generally horizontal lever retaining shelf 33 located at the top lever receiving opening 32 and with a spring strut retaining shelf 34 located below the top lever receiving opening 32 adjacent the upper end of the spring strut receiving notch 27 of the operating crank 25 of the top lever 16. The lever retaining shelf 33 is formed with a retainer lug passageway 35 and with an operating crank passageway 36, said passageways being positioned to permit the passage therethrough of the retainer lug 24 and the operating crank 25 of the top lever 16 when the top lever is at its barrel locking position as shown in FIGS. 1 to 3. In the embodiment shown in the drawings the portion of the frame 12 immediately surrounding the lever receiving opening 32 comprises the lever retaining shelf 33, the upwardly facing surface of the shelf 33 providing the lever support surface 31 and the downwardly facing surface of the shelf 33 providing a lever retaining surface 37. The retainer lug 24 and the operating crank 25 of the top lever 16 are located a predetermined distance below the bearing surface 22 of the lever, this distance being equal to the distance that the upwardly facing top lever support surface 31 and the downwardly facing top lever retaining surface 37 of the frame are spaced apart; and the retainer lug 24 and the operating crank 25 are positioned radially so that upward movement of the lug and the crank, and therefore the top lever 16, is blocked by the lever retaining surface 37 when the top lever is at its barrel unlocking position as shown in FIGS. 4 to 7.

A top lever spring 41 and spring strut 42 are mounted in the frame 12 rearwardly with respect to the top lever 16. The forward end of the spring strut 42 is received in the spring strut receiving notch 27 of the operating crank 25 of the top lever 16, the rearward end of the spring strut extending through a strut passageway 43 formed in the frame 12. The spring 41 and spring strut 42 press against the radially offset operating crank 25 thereby urging the operating crank and the top lever 16 to their bolt locking positions as shown in FIGS. 1 to 3. When the top lever 16 and operating crank 25 are at their bolt locking positions, the forward end of the spring strut 42 is positioned directly underneath the spring strut retaining shelf 34 of the frame. As a result, upward movement of the spring strut 42 and the top lever 16 is blocked by the undersurface 44 of the spring strut retaining shelf 34 when the operating lever is at its bolt locking position.

Figure 4:
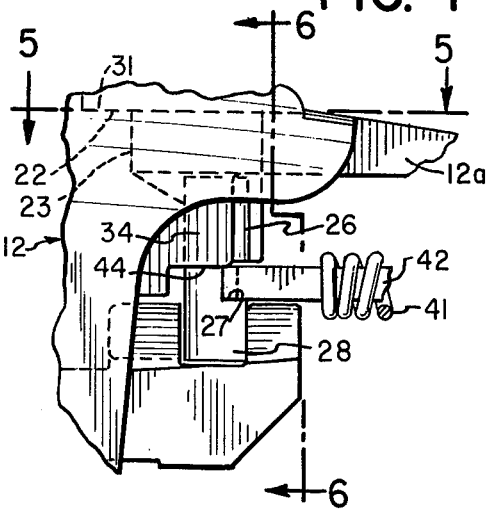
FIG. 4 is a fragmentary side elevation similar to FIG. 2 showing the top lever and the spring strut at their barrel unlocking positions.
Figure 6:
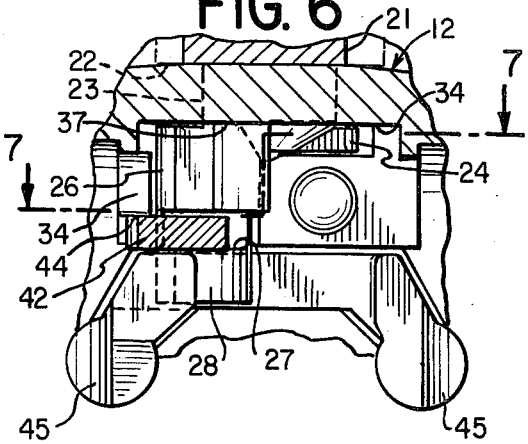
FIG. 6 is a sectional view along line 6—6 of FIG. 4.

A barrel lock bolt 45 is slidably mounted on the frame, the lock bolt 45 being movable longitudinally to its bolt locking position as shown in FIG. 2 or to its bolt unlocking position as shown in FIG. 4 by means of the top lever 16. That is to say, the lock bolt operating portion 28 of the radially offset operating crank 25 engages the barrel lock bolt 45 so that when the top lever is rotated to its barrel locking position as shown in FIG. 2 the lock bolt 45 is moved forwardly to its barrel locking position, and when the top lever 16 is rotated to its barrel unlocking position as shown in FIG. 4 the lock bolt is moved rearwardly to its barrel unlocking position.

From the foregoing it will be seen that when the top lever 16 is at its barrel locking position as shown in FIGS. 1 to 3 it is retained on the frame 12 by means of the spring strut retaining shelf 34 which blocks upward movement of the spring strut and the operating crank with which it is engaged. When the top lever 16 is at its barrel unlocking position as shown in FIGS. 4 to 7 it is retained on the frame 12 by means of the lever retaining shelf 33 which blocks upward movement of the retainer lug 24 and the operating crank 25 in the manner previously described.

In order to remove the top lever 16 from the frame 12 it is necessary to withdraw the forward end of the spring strut 42 from engagement with the spring strut receiving notch 27 of the operating crank thereby freeing the top lever 16 for upward movement. This is most readily accomplished by first rotating the top lever to its barrel unlocking position to move the spring strut 42 rearwardly and to compress the spring 41 as shown in FIG. 7. A compression pin (not shown) is then inserted in the pin hole 47 of the spring strut 42 to retain the spring strut at its rearward position. The top lever 16 is then rotated to its bolt unlocking position, and as the spring strut 42 is prevented by the compression pin from moving forwardly with the top lever, the spring strut receiving notch 27 is moved out of engagement with the forward end of the spring strut. The top lever 16 can now be removed from the frame 12 by lifting it upwardly, the retainer lug 24 and the operating crank 25 passing freely through the retainer lug passageway 35 and the operating crank passageway 36 formed in the top lever retaining shelf 33. The top lever 16 is replaced and retained in the frame 12 by reversing the above procedure.

We claim:

1. In a firearm having a frame, at least one barrel pivotally mounted on the frame; a barrel lock bolt movably mounted on the frame for releasably locking the barrel at its closed position; a top lever removably mounted on the frame, said top lever being rotatable to move the lock bolt from its barrel locking position to its barrel unlocking position and return; and top lever retaining means for retaining the top lever on the frame; the improvement in top lever retaining means which comprises;

a top lever having a bearing surface adapted to rest on a corresponding support surface of the frame, and a radially offset vertically elongated lock bolt operating crank disposed a predetermined distance below the bearing surface of the top lever, said operating crank having a spring strut receiving notch and a lock bolt operating portion;

a frame having a top lever receiving opening in which the top lever is rotatably received, a lever retaining shelf located at the top lever receiving opening of the frame, and a spring strut retaining shelf located below the top lever receiving opening of the frame adjacent the upper end of the spring strut receiving notch of the operating crank, said lever retaining shelf having an operating crank passageway that permits the passage therethrough of the operating crank of the top lever when the top lever is at its barrel locking position, upward movement of the operating crank and the top lever being blocked by said lever retaining shelf when the top lever is at its barrel unlocking position; and a top lever spring and spring strut mounted in the frame rearwardly of the top lever with the forward end of the spring strut received in the spring strut receiving notch of the operating crank of the top lever, upward movement of the forward end of the spring strut and the top lever being blocked by the strut retaining shelf when the top lever is at its barrel locking position.

2. The firearm according to claim 1 in which the top lever has a lever retainer lug disposed a predetermined distance below the bearing surface of the top lever, said lever retainer lug extending radially horizontally with respect to the vertical axis of rotation of the top lever, and in which the lever retaining shelf of the frame has a lever retainer lug passageway that permits the passage therethrough of the lever retainer lug when the top lever is at its barrel locking position, upward movement of the lever retainer lug and the top lever being blocked by said lever retaining shelf when the top lever is at its barrel unlocking position.

3. The firearm according to claim 1 in which the under surface of the spring strut retaining shelf of the frame is approximately level with and adjacent to the upper end of the spring strut receiving notch of the operating crank of the top lever.

4. The firearm according to claim 1 in which the lock bolt operating lower portion of the operating crank of the top lever engages the barrel lock bolt, said operating crank moving said lock bolt rearwardly to its barrel unlocking position when said top lever is rotated to its barrel unlocking position and said operating crank moving said lock bolt to its barrel locking position when said top lever is rotated to its barrel locking position.

5. In a firearm having a frame; at least one barrel pivotally mounted on the frame, said barrel being rotatable from its closed ready-to-fire position to its open loading and unloading position and return; a barrel lock bolt movably mounted on the frame for releasably locking the barrel at its closed position, said lock bolt being movable from its barrel locking position to its barrel unlocking position and return; a top lever removably mounted on the frame, said top lever being rotatable to move the lock bolt from its barrel locking position to its barrel unlocking position and return; a top lever spring urging the top lever and the lock bolt to their barrel locking positions; and top lever retaining means for retaining the top lever on the frame; the improvement in top lever retaining means which comprises:

a top lever integrally formed with a horizontally disposed downwardly facing annular bearing surface adapted to rest on a corresponding upwardly facing annular support surface of the frame, and a vertically elongated lock bolt operating crank disposed a predetermined distance below the annular bearing surface of the top lever; said operating crank being radially offset with respect to the vertical axis of rotation of the top lever and having a lever retainer upper portion, a spring strut receiving notch and a lock bolt operating lower portion;

a frame integrally formed with a top lever receiving opening in which the top lever is rotatably received, a generally horizontal lever retaining shelf located at the top lever receiving opening of the frame, and a spring strut retaining shelf located below the top lever receiving opening of the frame adjacent the upper end of the spring strut receiving notch of the operating crank of the top lever; said lever retaining shelf having an operating crank passageway that is adapted to permit the passage therethrough of the operating crank of the top lever when the top lever is at its barrel locking position, said lever retaining shelf also having a downwardly facing top lever retaining surface that blocks upward movement of the operating crank and the top lever when the top lever is at its barrel unlocking position; and a top lever spring and spring strut mounted in the frame rearwardly of the top lever with the forward end of the spring strut received in the spring strut receiving notch of the operating crank of the top lever, upward movement of the forward end of the spring strut and the top lever being blocked by the under surface of the strut retaining shelf when the top lever is at its barrel locking position.

6. The firearm according to claim 5 in which the top lever is integrally formed with a lever retainer lug disposed a predetermined distance below the annular bearing surface of the top lever, said lever retaining lug extending radially horizontally with respect to the vertical axis of rotation of the top lever, and in which the lever retaining shelf of the frame is formed with a lever retainer lug passageway that is adapted to permit the passage therethrough of the lever retainer lug when the top lever is at its barrel locking position, the downwardly facing top lever retaining surface of the lever retaining shelf blocking upward movement of the lever retainer lug and the top lever when the top lever is at its barrel unlocking position.

7. The firearm according to claim 5 in which the under surface of the spring strut retaining shelf of the frame is approximately level with and adjacent to the upper end of the spring strut receiving notch of the operating crank of the top lever.

8. The firearm according to claim 5 in which the lock bolt operating lower portion of the operating crank of the top lever engages the barrel lock bolt, said operating crank moving said lock bolt rearwardly to its barrel unlocking position when said top lever is rotated to its barrel unlocking position and said operating crank moving said lock bolt to its barrel locking position when said top lever is rotated to its barrel locking position.

* * * * *